United States Patent [19]

Hora

[11] 4,375,116

[45] Mar. 1, 1983

[54] VEHICLE WASHING BRUSH

[75] Inventor: Richard E. Hora, Riverside, Calif.

[73] Assignee: FMC Corporation, Chicago, Ill.

[21] Appl. No.: 277,761

[22] Filed: Jun. 26, 1981

[51] Int. Cl.[3] ..... A46B 13/02

[52] U.S. Cl. ..... 15/181

[58] Field of Search ..... 15/181, 182, 183, 179, 15/198, 200

[56] References Cited

U.S. PATENT DOCUMENTS 3,407,425 10/1968 Drumm ..... 15/181

3,602,936 9/1971 Drumm ..... 15/181

3,763,516 10/1973 Welter ..... 15/182

3,839,763 10/1974 Gould ..... 15/181

*Primary Examiner*—Peter Feldman

*Attorney, Agent, or Firm*—Henry M. Stanley; R. B. Megley

[57] ABSTRACT

A car wash brush, which includes a plurality of annular bristle-carrying rings secured to a central core to form a cylindrical brush, features a unique arrangement for mounting the rings on the core in driven engagement so that the contour of the brush can be readily varied and so that a minimum of wear takes place between the driving and the driven elements of the brush.

8 Claims, 6 Drawing Figures

FIG_1
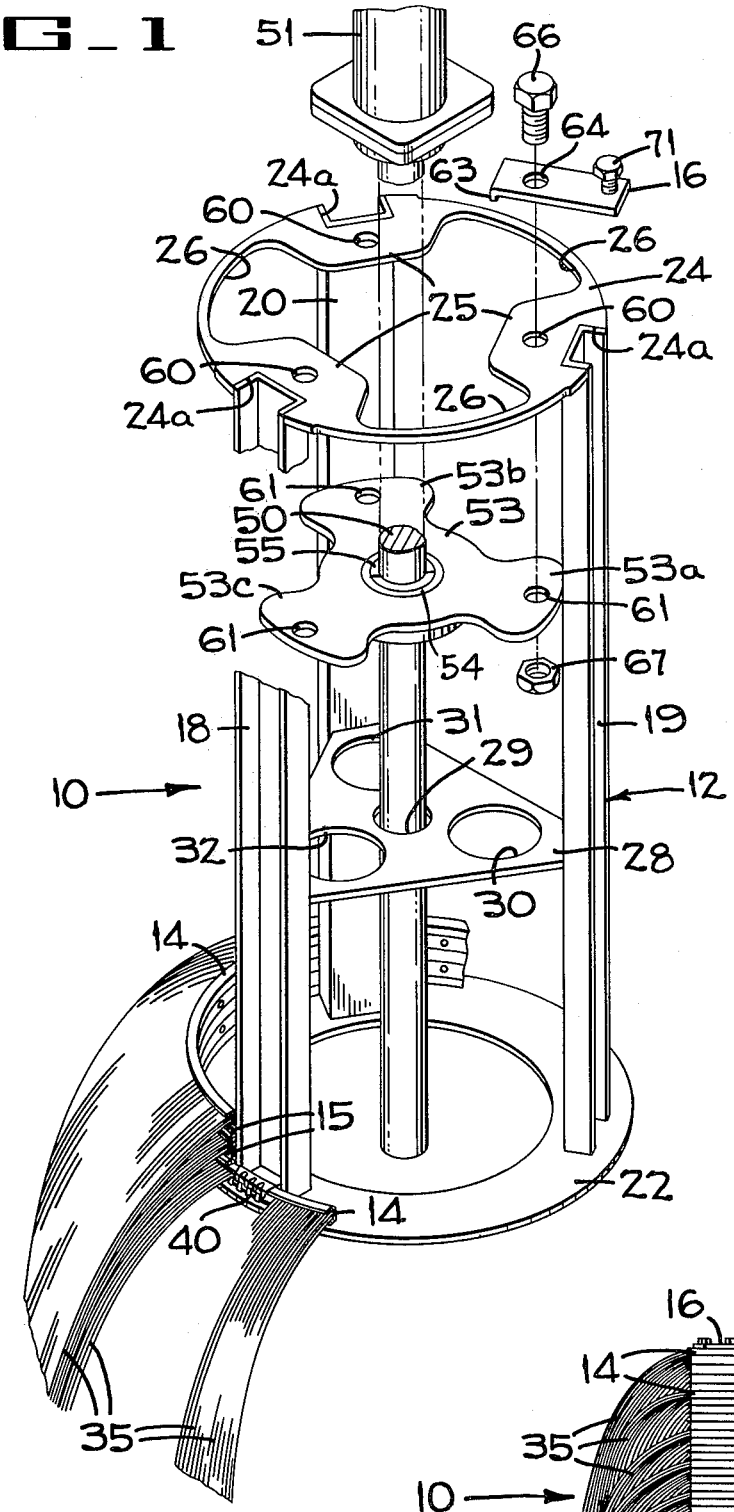
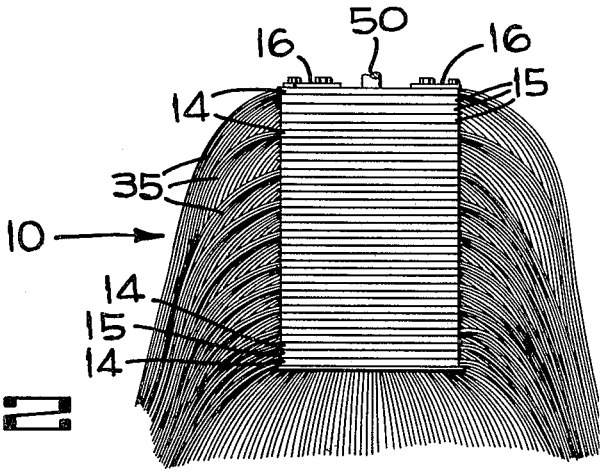
FIG_2

FIG_4
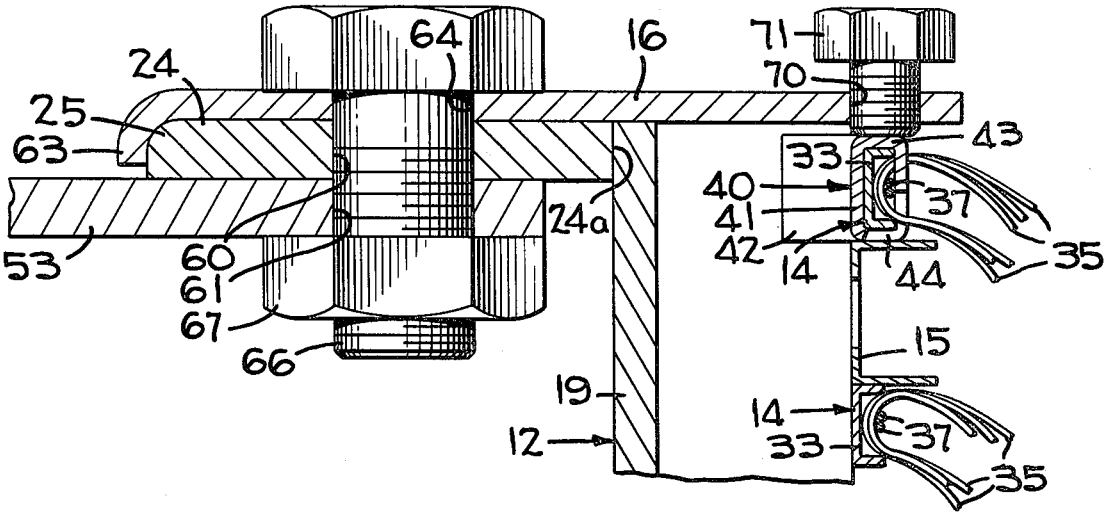
FIG_3
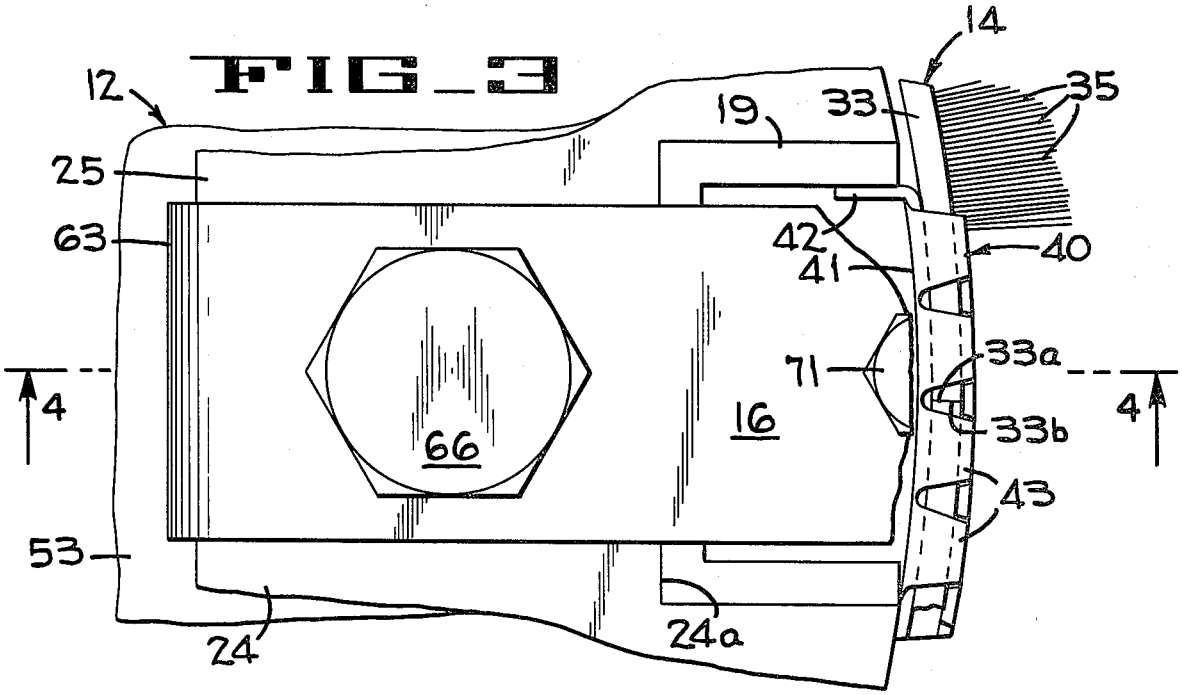
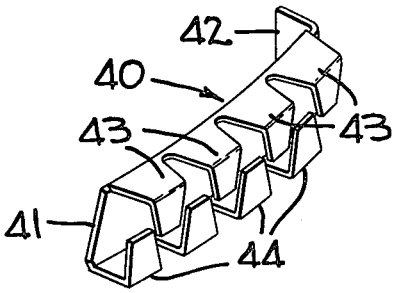
FIG_6
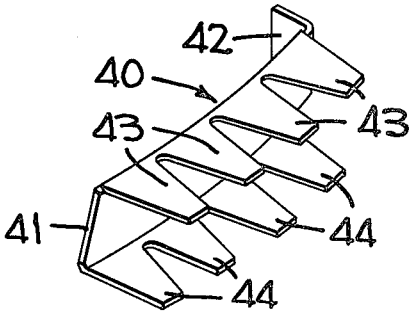
FIG_5

VEHICLE WASHING BRUSH

BACKGROUND OF THE INVENTION

Brushes for washing vehicles are currently marketed which are made by three different methods. In one method, filaments are secured to the outer surface of cylindrical or semi-cylindrical cores, with the major portion of each filament extending outwardly from the core. In a second method, the filaments have ends secured in an elongate holder with the major portion of the filaments extending away from the holder. A number of such elongate brush strips are mounted around a core or shaft in parallel relation thereto to form a brush. A third method involves securing a plurality of side-by-side filaments in a single elongate filament holder, then winding the holder in spiral formation around a cylindrical core, and anchoring the holder to the core.

In one type of car-wash installation, brushes are mounted in upright position and rotated about vertical axes. Since the automobile surfaces that are to be contacted are irregular in configuration, not all portions of a truly cylindrical brush engage a car surface during the washing operation and therefore it is an advantage to have a brush whose profile is shaped to conform generally to the configuration of the surface to be contacted. Similarly, protruding parts of a vehicle, such as bumpers, sometimes cause excessive wear at localized areas of the brush. It is therefore desirable that car-wash brushes can be easily modified to vary their profiles and to change the concentration of filaments at high-wear areas of the brush.

When using the first method mentioned above, difficulty is experienced in making brushes having the required filament density and in assembling the various components of the brush. Brushes that are made according to the second or third method have the disadvantage that they are relatively expensive and, in addition, the cores must be discarded or reprocessed before they can be used again. None of the three methods produce car washing brushes that can be easily assembled or are adapted for easy modification to accommodate irregular car surfaces or various high-wear conditions of operation. The brush of the present invention is made up of a plurality of disc-like filament units that are removably mounted on a core. A similar brush construction has been used to form street sweeping brushes. However, this type of brush makes use of steel wire or tough polypropylene bristles, is substantially cylindrical in configuration, and generally requires no special external configuration for accommodating irregular surfaces or varying wear conditions. The patent to Drumm U.S. Pat. No. 3,602,936 discloses a disc-type street sweeper brush wherein the discs are disposed in close side-by-side relation to form a generally cylindrical brush. This patent also discloses a disc construction in which the adjacent ends of a split bristle-holding ring are held together by a clip which also provides abutment surfaces that are engaged in driven relation by the central core of the brush. A disadvantage of this arrangement resides in periodic engagement of the core with the clip which results in mechanical wear and possible breakage.

An object of the present invention is to provide a brush construction for a car-washing brush that lends itself for easy modification to accommodate various car-washing operating conditions, and one which features a unique design for the individual discs and for driving the discs from a central core.

SUMMARY OF THE INVENTION

A car wash brush assembly is adapted for mounting onto a driven shaft which is oriented so that the shaft extends in a direction having a vertical component. A shaped plate is affixed to the shaft and a brush frame includes a lower end plate, and an upper end plate and a plurality of longitudinally disposed parallel channels extending between and affixed at opposite ends thereof to the end plates. The upper end plate has an opening therein which is shaped to allow passage therethrough of the shaped plate in a first angular orientation and to bar passage in a second angular orientation. A plurality of brush filament rings and spacer rings are configured to stack in a predetermined sequence above the lower end plate so that they surround the plurality of parallel channels. Means is provided which cooperates between the brush frame and the brush filament rings for preventing rotation therebetween. Further, means is provided for affixing the upper end plate to the shaped plate after the shaped plate has passed through the upper end plate in the first orientation and has then been angularly adjusted to the second orientation.

DESCRIPTION OF THE DRAWINGS

FIG. 1 is an exploded perspective of a car-washing brush constructed in accordance with the teachings of the present invention.

FIG. 2 is a diagrammatic side elevation of a brush of the present invention, with the filaments on the near side of the brush removed from the unit to more clearly disclose the construction of a core.

FIG. 3 is an enlarged plan view of a portion of one end of a brush assembly.

FIG. 4 is a section taken along line 4—4 of FIG. 3.

FIG. 5 is a perspective of a clip used in each disc assembly of the brush.

FIG. 6 is a perspective, identical to FIG. 5, but showing the teeth of the clip in a bent, interdigitated condition, but not showing the filaments or the filament holder that is enclosed by the teeth in the bent-over position.

DESCRIPTION OF A PREFERRED EMBODIMENT

In FIG. 1 the reference numeral 10 indicates generally a brush assembly, constructed according to the teaching of the present invention, comprising on core 12 on which a plurality of filament rings 14 and spacer rings 15 are locked by means of several hold-down plates 16 (one only being shown). The frame 12 is made up of three upright channels 18, 19, and 20 secured between a lower annular end plate 22 and an upper annular end plate 24. The upper plate has notches or recesses **24*a* in its periphery in which upper end portions of the channels are welded. The annular plate 24 has three equi-spaced inwardly-projecting wall segments 25 that define three deep recesses 26**.

At their lower ends, the channels 18–20 are welded to the face of the end plate 22 in abutting relation to hold the lower end plate in parallel relation with the upper end plate. A rigid reinforcing plate 28, of generally triangular configuration, which is welded to the inner faces of the three channels, is provided with a central circular opening 29 and three outer openings 30, 31 and 32. The channels, end plates, and the reinforcing plate are rigid steel members.

As will be explained presently, the filament rings and the spacers are removably mounted on the frame and accordingly, each brush may have as many filament rings as is needed for the particular type of job for which the brush is to be used. In FIG. 2, a car wash brush is schematically shown that has only one spacer 15 between each of the lowermost filament rings 14, and more than one spacer between the filament rings in the upper portions of the brush. Such a car wash brush is adapted to rotate about a vertical axis and the concentration of filaments at the lower end where the bumper of a car will be engaged provides adequate filament surface for accomplishing the washing action with a minimum of wear on each bristle.

Each filament ring includes a filament-retaining ring 33 (FIG. 4) that is split and has ends 33*a* and 33*b* in abutting relation. The retainer ring 33 is a shallow channel in cross-section (FIG. 4) which receives the bight portions of a plurality of folded filaments 35 (FIG. 4) and at least one wire 37 which engages the filaments and holds them in the retainer ring. The ends of the split retainer ring 33 are held in abutting contact and the wires 37 are held in the retainer ring by a clip 40 which includes a rear wall 41 (FIG. 5), a tab 42 bent outwardly from one end of the rear wall at substantially a right angle thereto, a plurality of upper teeth 43, and a plurality of lower teeth 44. The upper teeth are in staggered relation to the lower teeth so that when they are crimped over to enclose the filaments 35 and the wires 37, as shown in FIGS. 4 and 6, the ends of the teeth interdigitate.

The brush is especially adapted to be mounted in driven engagement on a vertically oriented shaft, such as the shaft 50 (FIG. 1) which is journaled in the lower end of a tubular support member 51. In one arrangement, shaft 50 has a flange plate 53 adjustably secured thereon by a Taper-lock* bushing/hub assembly or a currently preferred QD bushing/hub assembly, both manufactured by Martin Sprocket and Gear Inc., Arlington, Tex., both of which include a sleeve 54 welded in an opening in the flange plate and a plurality of arcuate elements 55 that are arranged to move inwardly to grip the shaft 50. The flange plate 53 has three equispaced lobes 53*a*–53*c* which are similar in shape to the recesses 26 in the end plate 24 but each lobe is proportioned to pass through one of the recesses.

*Trademark

To assemble the brush, the frame 12 is placed in upright position with the annular end plate 22 resting on a generally horizontal support surface such as a workroom floor. Filament rings 14 and spacer rings 15 are then dropped into position on the frame, one on top of the other, in the sequence designed to provide the desired concentration of filaments. It should be noted that, in positioning a filament ring on the frame, the inturned tab 42 of each clip 40 is disposed in one of the frame channels 18, 19 or 21 in flat, abutting contact with an internal wall of the channel, as seen in FIG. 4. Although not necessary, in a preferred arrangement, the tab 42 of the lowermost ring is disposed in one of the channels, as for example channel 18; the tab of the ring next above is placed in channel 19; the tab of the ring next above is disposed in channel 20, and this sequential positioning of the tab in the channels is continued until the top of the frame is reached.

In a typical car wash installation, the lower end of the shaft 50 (FIG. 1) is about 2½ feet above the ground. Accordingly, the newly-assembled brush unit can be moved to a position directly under the shaft and then moved directly upwardly. During this upward movement, the opening 29 in the reinforcing plate 28 receives the lower end portion of the shaft 50, and the lobes 53*a*–53*c* of the flange plate pass through the recesses 26 in the end plate 24. When the end plate 24 is above the flange plate 53, the brush assembly is rotated approximately sixty degrees about a vertical axis and lowered until the wall portions 25 on the end plate 24 rest on the upper surfaces of the lobes 53*a*–53*c* of the flange plate. The brush assembly may have to be shifted slightly to bring a hole 60 in each wall segment 25 of the end plate 24 into vertical alignment with a hole 61 in one of the lobes 53*a*–53*c*. Then, one of the three hold-down plates 16 is positioned over the upper end of each of the channels 18–20 with a curved lip 63 (FIG. 4) of the plate overlying the inner curved edge of the adjacent wall section 25 and with an opening 64 in the plate disposed in alignment with the previously aligned holes in the wall section and in the flange plate. When the three sets of holes are in alignment, a bolt 66 is pushed through each set of holes and a nut 67 is threaded onto the bolt and moved up into flat, abutting contact with the underside of the flange plate to lock the brush assembly to the flange plate.

Each of the hold-down plates 16 has a tapped hole 70 (FIG. 4) near its outer end. After the brush assembly is locked on the flange plate, a capscrew 71 is threaded through the hole 70 in each hold-down plate until its lower end presses down on the topmost filament ring or spacer ring, whichever is uppermost. When the three capscrews are tightened down on the ring, the entire assembly is locked in place.

After the brush is installed on the shaft in the manner mentioned above, it can be adjusted up or down on the shaft by loosening the Taper-lock bearing, shifting the brush along the shaft to a selected position, and reengaging the bearing. In this manner, the brush can be shifted to replace worn areas with relatively-unworn areas, or to shift sections of the brush that have high filament concentrations to locations where they will be most effective. The degree to which the brush moves laterally toward and away from the axis of shaft 50 depends upon whether or not the lower end of the shaft extends to a point below the reinforcing plate 28 after the brush is locked on the frame. If the shaft 50 does extend below the plate 28, the lateral movement of the brush during rotation is limited by the amount of clearance between the shaft and the side edges of the hole 29, and thus the plate 28 acts as a movement-control member. For some installations such a restricted lateral movement is highly desirable. In other installations, the operator may require a larger amount of lateral movement and, in such case, the flange plate 53 is secured in a position on shaft 50 such that the lower end of the shaft is above the reinforcing plate 28.

From the foregoing description, it will be seen that the present invention provides a brush that is not only easy to assembly but one that can be readily adjusted on its shaft to obtain the most advantageous operating conditions. The clip 40 provides a particularly effective mechanism for securing the bristles in place while providing unit drive tabs 42 that maintain driving contact with the channels of the frame so that a minimum of impact force is applied to each clip when the brush is put into movement and, as a result, a minimum of mechanical wear and breakage is encountered. Also, the ability to vary the concentration of filaments by the selective use of one or of several spacer rings between adjacent filament rings, makes possible a brush that may be specially designed for the particular use to which it is to be subjected. Further, when an individual filament ring is being made up, the effective outer diameter of the ring is determined by the length of the filaments that are secured in the ring. If all rings have the same maximum diameter, the brush will have an outer contour of constant diameter. Accordingly, by selecting filament rings of different maximum diameters and selectively installing them on the frame, a brush having a desired outer contour that is particularly adapted for washing specific areas of automobiles can be obtained.

Although the best mode contemplated for carrying out the present invention has been herein shown and described, it will be apparent that modification and variation may be made without departing from what is regarded to be the subject matter of the invention.

I claim:

1. A car wash brush assembly adapted for mounting onto a driven shaft which is oriented so that the shaft extends in a direction having a vertical component, comprising a shaped plate affixed to the shaft, a brush frame including a lower end plate, an upper end plate and a plurality of longitudinally disposed parallel channels extending between and affixed at opposite ends thereof to said end plates, said upper end plate having an opening therein allowing passage therethrough of said shaped plate in a first angular orientation and barring passage in a second orientation, a plurality of brush filament rings, a plurality of spacer rings, said brush and spacer rings being configured to stack in predetermined sequence above said lower end plate surrounding said plurality of parallel channels, means cooperating between said brush frame and said brush filament rings for preventing rotation therebetween, and means for affixing said upper end plate to said shaped plate after the latter has passed through the former in said first orientation and has been angularly adjusted to said second orientation.

2. A car wash brush assembly as in claim 1 wherein said predetermined sequence within said brush and spacer ring stack comprises a greater density of brush rings at one end of said brush frame than at the other.

3. A car wash brush assembly as in claim 1 wherein said means for preventing rotation comprises a tab on each brush filament ring disposed in flat abutting contact with a wall on one of said parallel channels.

4. A car wash brush assembly according to claim 1 wherein said lower end plate includes a flat abutment wall facing said upper end plate, and said upper end plate is provided with a plurality of equispaced notches in its periphery, each of said channels opening radially outward and being welded at one end in flat abutting engagement with the abutment wall of said lower plate and being welded at its other end in one of said notches.

5. A car wash brush assembly according to claim 1 wherein each brush filament ring comprises a split annular channel having its open side facing radially outwardly; a plurality of folded filaments having their bight portions disposed in said annular channel; wire means locking said filaments in said annular channel; and a generally U-shaped clip having a rear wall in abutting engagement with the radially inner face of said split annular channel on both sides of the split ends, an upper wall projecting outwardly from said rear wall at substantially right angles thereto and having a plurality of teeth with end portions extending downwardly at a point radially outwardly of said wire means, and a lower wall porjecting outwardly from said rear wall at substantially right angles thereto and having a plurality of teeth extending upwardly adjacent said downwardly-extending teeth, said teeth being effective to lock said wire in said channel and hold the ends of said annular channel adjacent each other.

6. In combination, a drive shaft a flange plate secured to said drive shaft, said flange plate having a plurality of equi-spaced peripheral lobes, a core bolted to said flange plate, said core including a plurality of longitudinally disposed channels opening radially outward and extending parallel to the core axis, a plurality of brush filament rings configured to surround said channels and to be stacked thereon in axially extending array, a plurality of spacer rings interspersed between said brush filament rings, a tab extending from each filament ring disposed in flat abutting contact with a wall of one of said channels, and means for retaining said stack of filament and spacer rings in axial position on said core.

7. The combination of claim 6 wherein said core has one end plate with a central opening including a plurality of recesses and an opposing end plate, each recess being configured and proportioned to allow one of the lobes of said flange plate to pass therethrough, whereby said core can be secured to said flange plate after the flange plate is positioned inside of said core between said one and opposing end plates.

8. The combination of claim 6 wherein said core has a circular end plate with a plurality of equispaced radially-inwardly projecting wall portions defining a plurality of recesses, each recess being configured and proportioned to allow one of the lobes of said flange plate to pass therethrough to position said flange plate inside said core, whereby said core is placed on said drive shaft by moving said core axially of said shaft to move said circular end plate past said flange plate, said core being rotatable about its lontigudinal axis to position each one of said radially-inwardly projecting walls in axial alignment with one of said lobes, and means for securing each wall to one of said lobes.

* * * * *